US006168376B1

(12) United States Patent
Wagner

(10) Patent No.: US 6,168,376 B1
(45) Date of Patent: Jan. 2, 2001

(54) ROTARY PUMP WITH VENTILATED CHAMBER

(75) Inventor: Peter Wagner, Werdohl (DE)

(73) Assignee: Brinkmann Pumpen, K.H. Brinkmann GmbH & Co. KG (DE)

( * ) Notice: Under 35 U.S.C. 154(b), the term of this patent shall be extended for 0 days.

(21) Appl. No.: 09/244,115

(22) Filed: Feb. 4, 1999

(30) Foreign Application Priority Data

Feb. 7, 1998 (DE) ..... 198 04 907

(51) Int. Cl.[7] ..... F04D 17/18
(52) U.S. Cl. ..... 415/169.1; 415/56.2; 415/88
(58) Field of Search ..... 415/169.1, 56.1, 415/56.2, 56.3, 56.4, 56.5, 56.6, 88, 206, 208.3, 211.2

(56) References Cited

U.S. PATENT DOCUMENTS 4,749,332 * 6/1988 Coffinberry ..... 415/55
4,793,766 * 12/1988 Kumata ..... 415/53 T
4,981,413 * 1/1991 Elonen et al. ..... 415/115
5,209,641 * 5/1993 Hoglund et al. ..... 416/223 B
5,221,178 * 6/1993 Yoshioka et al. ..... 415/55.1
5,226,790 * 7/1993 Serafin ..... 415/208.3
5,248,223 * 9/1993 Hill ..... 415/55.3
5,375,970 * 12/1994 Iwai et al. ..... 415/55.1
5,413,462 * 5/1995 Alberni ..... 415/169.1

FOREIGN PATENT DOCUMENTS 1048479 1/1959 (DE) .
4325549 8/1995 (DE) .
0460597 12/1991 (EP) .
0936356A1 * 8/1999 (EP) .

* cited by examiner

*Primary Examiner*—F. Daniel Lopez
*Assistant Examiner*—Liam McDowell
(74) *Attorney, Agent, or Firm*—Rothwell, Figg, Ernst & Manbeck p.c.

(57) ABSTRACT

Centrifugal pump with a pump chamber (18) housing a radial impeller (20) and aspiration port arranged coaxially with the radial impeller, and at least one ventilating conduit (26) that leads from the inner radial area of the pump chamber to the outside, wherein the outer circumferential edge of the pump chamber (18) is fitted with interference contours (32) that are essentially directed tangentially to swirl the liquid flow.

4 Claims, 1 Drawing Sheet

ROTARY PUMP WITH VENTILATED CHAMBER

BACKGROUND OF THE INVENTION

The invention relates to a centrifugal pump with a pump chamber that accommodates a radial impeller, an aspiration port that is arranged coaxially to the radial impeller and at least one ventilating conduit leading from the pump chamber's inner radial area to the outside.

In DE 43 25 549 C3 a centrifugal pump of this type is described which specifically serves the purpose of pumping out the coolant or cooling lubricant emulsion accumulated in the engine bed of a machine tool. The liquid will then be reintroduced to the tool by means of another pump, if required.

Cooling lubricants used with this type of machine tools have become less and less harmful to the environment over recent years. However, newly developed cooling lubricants have a relatively poor gas evolution. Consequently, the liquid pumped out of the engine bed has an increased air share. The radial impeller's centrifugal effect facilitates a separation of air and liquid in the pump chamber generating an air cushion in the pump chamber's inner radial area which prevents the intake of additional liquid. Specifically during the start phase of pump operation this may cause problems of delivery.

In order to avoid these problems, the aforementioned pump incorporates ventilating conduits leading back from the pump chamber's inner radial area along the aspiration port's wall to the liquid pit in the engine bed. In addition, an axial impeller is provided inside the aspiration port improving the intake of liquid into the pump chamber. If an air cushion is generated in the pump chamber, the pressure in said cushion is higher than the ambient pressure. This facilitates evacuation of the air via ventilating conduits without a need for an extract fan. An improved pump performance specifically during the start phase can be achieved with this system.

The invention's purpose is to further improve the pump performance and the behavior during the start phase of an aforementioned pump type.

SUMMARY OF THE INVENTION

The problem is solved according to the invention by fitting interference contours to the pump chamber's external circumferential edge in order to swirl the liquid flow, which runs essentially in a tangential direction.

Experiments have shown that this measure can further reduce the generation of an air cushion in the pump chamber and, consequently, improve the pump performance and the behavior during the start phase. This is probably caused by the fact that the liquid's swirling reduces the liquid flow's tangential velocity component. This, in turn, reduces the centrifugal effect causing the separation of air and liquid without impeding the liquid flowing off into the pump's riser. Moreover, this measure produces a higher pressure in the pump chamber and, thus, an improved evacuation of the air via the ventilating conduits.

The interfering contours are preferably formed by individual pocket-shaped deepenings in the pump chamber's circumferential wall and the area of the pump chamber's bottom wall located radially outside the impeller, respectively.

BRIEF DESCRIPTION OF THE DRAWINGS

In the following the details of a preferred embodiment will be explained by means of the following illustrations.

DETAILED DESCRIPTION OF THE INVENTION

Figure 1:
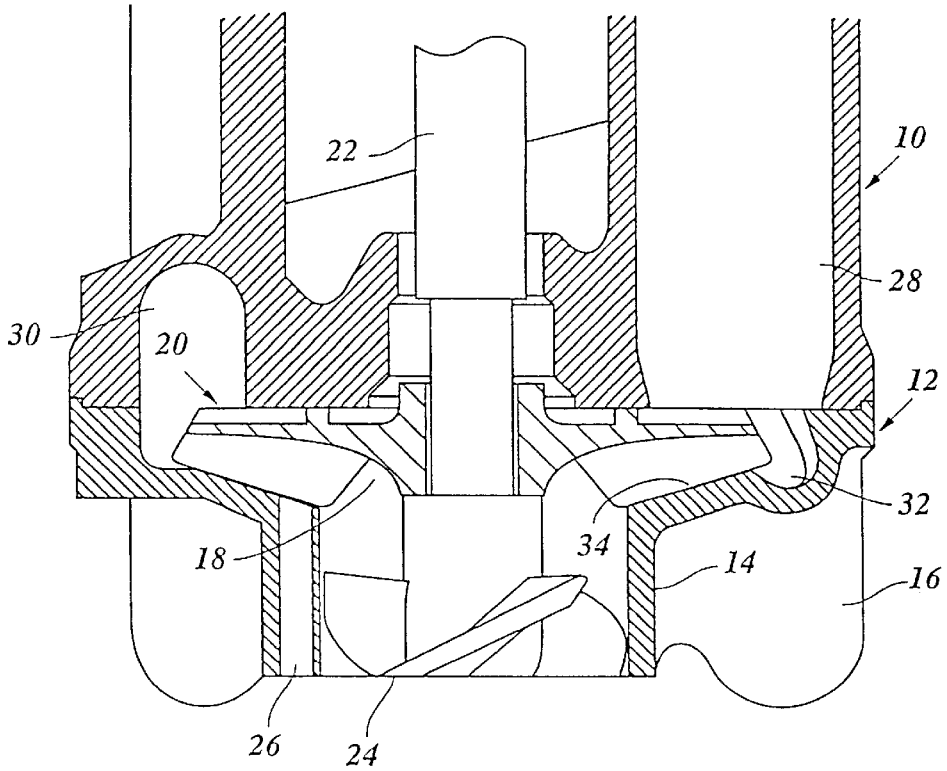
FIG. 1 depicts an axial cross-section through the lower terminal area of a centrifugal pump.

The centrifugal pump shown in FIG. 1 has a casing 10 that is terminated with the bottom element 12 at the lower edge. The bottom element forms a cylindrical aspiration port 14 that dips vertically into a liquid reservoir located at a machine tool's engine bed (not shown).

Furthermore, the bottom element 12 is fitted with several legs 16 distributed to the circumference, protruding downward from the aspiration port's 14 lower opening and ensuring a sufficient distance between the intake opening at the lower edge of the aspiration port 14 and the bottom of the liquid reservoir. Above the aspiration port 14, the bottom element forms a pump chamber 18 holding a radial impeller 20.

A pump shaft 22 rests in the casing 10 and is arranged coaxially to the aspiration port 14. Shaft and pump chamber 18 are sealed from one another by means of a shaft seal (not shown). The pump shaft 22 is extended beyond the radial impeller 20 and holds an axial impeller 24 inside the aspiration port 14. Said impeller is fitted with individual wings arranged in the shape of a spiral. The aspiration port's 14 circumferential wall is fitted with several ventilating conduits 26 arranged in regular angular distances and leading back from the inner radial area of the pump chamber 18 to the lower edge of the aspiration port 14. In the shown example, the lower edges of the ventilating conduits 26 are flush with the lower edges of the aspiration port 14.

The casing 10 also forms a vertical riser 28 that is at its lower edge linked with the pump chamber's 18 periphery in a certain circumferential position, and a wraparound ring channel 30 that is linked over its entire length with the outer radial area of the pump chamber 18 and rises in the pump shaft's 22 direction of rotation toward the riser 28.

During operation of the centrifugal pump the liquid is taken in initially by means of the axial impeller 24 and delivered to the pump chamber 18 via the aspiration port 14. The radial impeller 20 pumps the liquid toward the outer periphery of the pump chamber 18 and into the riser 28 via the ring channel 30.

The air contained in the pumped liquid is separated from the liquid by the radial impeller's 20 centrifugal effect and accumulated in the inner radial area of the pump chamber 18. When—for this reason—the radial impeller 20 is working increasingly in air and not in the liquid, the pump performance will decrease while the pump performance of the axial impeller 24 remains essentially unchanged. Consequently, the pressure in the area of the upper ends of the ventilating conduits 26 is higher than the ambient pressure which causes the evacuation of the air via the ventilating conduits 26. In this way, a further expansion of the air cushion in the pump chamber 18 and a reduction of the pump performance is prevented.

This effect is further supported by the design of the outer circumferential area of the pump chamber 18. As can be seen in FIG. 1 on the right side, the pump chamber 18 forms a pocket 32 located radially outside the impeller 20. The pocket's bottom is deeper than that of the remaining circumferential areas of the pump chamber (e.g. in FIG. 1 on the left side). Moreover, the pocket 32—viewed from above—forms an undercut in the outer circumferential wall of the pump chamber.

Figure 2:
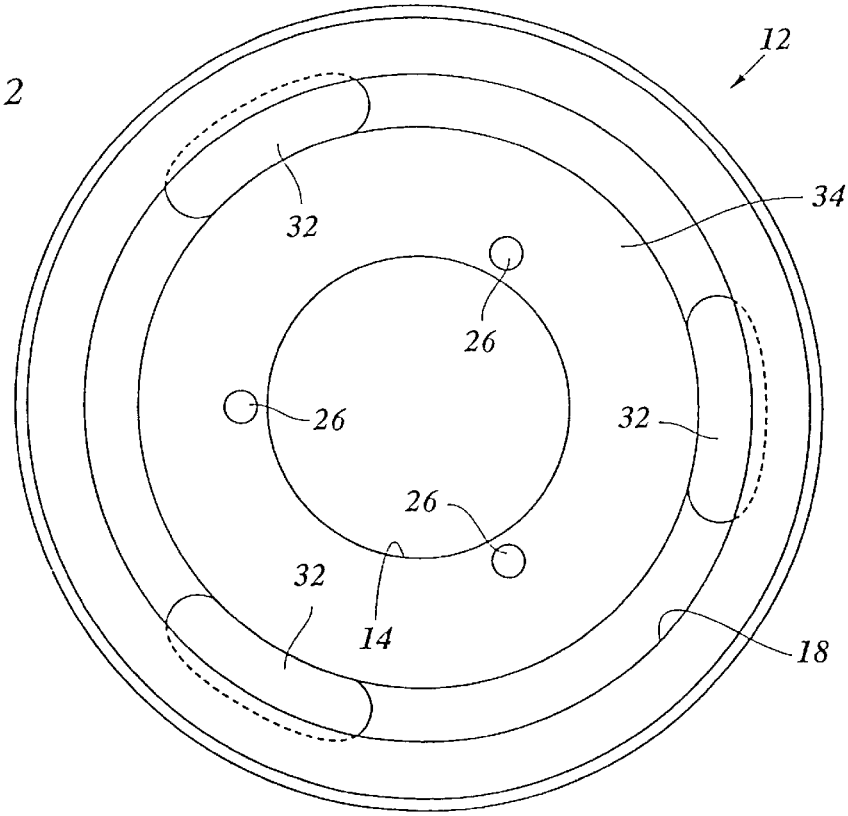
FIG. 2 depicts a top view of the bottom element of a centrifugal pump in accordance with FIG. 1.

In FIG. 2 it can be seen more clearly that three pockets 32 of this type are arranged in a regular angular distance. The pockets are located in the shape of an arc in the circumferential direction of the pump chamber and have rounded-off edges. They are stretched over an angular range of 40° approximately and are directly adjacent—in radial direction—to a conical area 34 of the bottom wall of the pump chamber. Said area is sloped like a funnel toward the aspiration port 14 and scanned by the wings of the radial impeller 20.

The liquid pumped to the outer circumferential area of the pump chamber 18 by the radial impeller 20 flows essentially in the direction of the circumference and is then evacuated in axial direction into the riser 28 via the ring channel 30. However, the pockets ensure a swirling of the liquid flow, which reduces the circumferential component of the flow velocity. The separation of air and liquid is reduced by the lower circumferential velocity and the swirling which also alters the pressure ratio in the pump chamber so that the air—nevertheless accumulated in the pump chamber's 18 inner area—can be evacuated more easily via the ventilating conduits 26.

This facilitates an improved pump performance.

If the liquid level in the reservoir—into which the aspiration port 14 is sunk—comes down to the height of the lower end of the aspiration port 14, the pump will start a slurp operation, i.e. a mix of air and liquid will be taken in. In this process, the pump performance decreases and the liquid level rises again. The measures described above specifically ensure that after such a slurp-operation phase the air cushion in the pump chamber 18 will be reduced rapidly and the pump will swiftly reach its maximum pump performance again.

What is claimed is:

1. A centrifugal pump, comprising:

a radial impeller (20), a pump chamber (18) housing the radial impeller (20), the pump chamber (18) including at least one interference contour (32) for creating local swirls that reduce a tangential velocity component of a liquid flow within the pump, an aspiration port (14) arranged coaxially with the radial impeller (20), a riser (28) connected to an outer periphery of the pump chamber (18), the riser (28) providing a discharge conduit from the pump, and at least one ventilating conduit (26) that leads from the inner radial area of the pump chamber to the outside.

2. Centrifugal pump in accordance with claim 1, characterized in that the interference contours are formed by one or several pockets (32) distributed over the circumference located in the outer circumferential wall and/or the bottom wall of the pump chamber (18), respectively.

3. Centrifugal pump in accordance with claim 2, characterized in that the pump chamber (18) is open in its circumferential area toward a ring channel (30) and a riser (28), respectively, and that the circumferential wall of the pump chamber (18) is undercut in the area of the pockets (32).

4. Centrifugal pump in accordance with claim 2, characterized in that the pockets (32) are shaped as stretched-out deepenings with rounded-off edges arranged in circumferential direction.

* * * * *